US005651156A

United States Patent [19]

Oomura

[11] Patent Number: 5,651,156

[45] Date of Patent: Jul. 29, 1997

[54] GUARDRAIL CLEANER

[75] Inventor: Yasutoshi Oomura, 767-2 Gokanshima, Fuji-shi, Shizuoka-ken, Japan

[73] Assignees: Yasutoshi Oomura; Kouei Kogyo K. K.; Kabushiki Kaisha Idegumi, all of Fuji, Japan

[21] Appl. No.: 681,410

[22] Filed: Jul. 23, 1996

[51] Int. Cl.[6] ..... A46B 13/00; B05C 5/00

[52] U.S. Cl. ..... 15/21.1; 15/88.4; 15/246; 15/312.1; 118/323; 118/72

[58] Field of Search ..... 118/72, 323; 15/21.1, 15/50.3, 52, 88, 88.4, 103.5, 77, 312.1

[56] References Cited

U.S. PATENT DOCUMENTS

| | | | |
|---|---|---|---|
| 3,532,070 | 10/1970 | Lamarque | 118/72 |
| 3,786,779 | 1/1974 | Brunel | 15/88.4 |
| 3,935,610 | 2/1976 | Vogt | 15/88.4 |
| 4,033,285 | 7/1977 | Dugle | 118/72 |
| 5,069,234 | 12/1991 | Nielsen | 15/88 |

FOREIGN PATENT DOCUMENTS

| | | | |
|---|---|---|---|
| 1029099 | 1/1975 | Italy . | |
| 1034392 | 3/1975 | Italy . | |
| 0423526 | 6/1979 | U.S.S.R. | 15/88 |
| 2050876 | 1/1981 | United Kingdom . | |

*Primary Examiner*—David Scherbel
*Assistant Examiner*—Randall Chin
*Attorney, Agent, or Firm*—Oblon, Spivak, McClelland, Maier & Neustadt, P.C.

[57] ABSTRACT

A guardrail cleaner includes a frame equipped with upper rollers for mating with an upper guardrail edge and a lower roller for pressing against the guardrail rear surface, a drive wheel for moving the cleaner along the guardrail by traction on the surface thereof, rotating device for rotating the drive wheel, a wire buffing wheel for cleaning the guardrail surface, and a device for rotating the wire buffing wheel. The cleaner is optionally equipped with a dirt catcher and/or paint spraying nozzles.

3 Claims, 4 Drawing Sheets

GUARDRAIL CLEANER

BACKGROUND OF THE INVENTION

1. Field of the Invention

This invention relates to a guardrail cleaner which cleans the surface of a guardrail as it moves along the guardrail under its own power.

2. Description of the Prior Art

Although the surfaces of guardrails installed along roadways are smoothly painted, they are nevertheless progressively soiled by dust, mud and the like and require periodic manual cleaning. The work of manually cleaning guardrails over a long stretch of road is monotonous and requires considerable perseverance.

While it is possible to clean guardrails using a truck equipped with a rotating brush and water spraying means, it is not economical to spend a large amount of money on the simple job of guardrail cleaning. Since cleaning guardrails over a long section of road requires a large amount of water, moreover, the efficiency of the work is low owing to the need to frequently replenish the water supply. So while it is easy to conceive the idea of mechanizing the cleaning of guardrails, it is difficult to put the idea into practice.

The object of this invention is to provide a structurally simple guardrail cleaner capable of cleaning the surface of a guardrail with high efficiency as it moves along the guardrail under its own power.

SUMMARY OF THE INVENTION

For achieving this object, the invention provides a guardrail cleaner comprising

- a frame equipped with multiple upper rollers for mating with the upper edge of a guardrail and at least one lower roller for contacting the rear surface of the guardrail at its lower edge,
- a drive wheel mounted on the frame for moving the cleaner along the guardrail by traction on the surface thereof,
- rotating means mounted on the frame for rotating the drive wheel,
- at least one wire buffing wheel rotatably supported between upper and lower bearings for cleaning the guardrail surface by buffing, and
- means for rotating the wire buffing wheel.

A dirt catcher can be mounted on the frame for collecting dust and dried mud thrown off from the guardrail surface by the buffing wheel.

Multiple paint spraying nozzles can be mounted at the rearward end of the frame.

The guardrail cleaner according to the invention is clamped on a guardrail by mating the upper rollers with the upper edge of the guardrail and bringing the lower roller or rollers into contact with the rear surface of the guardrail at its lower edge. When the drive wheel is rotated, the cleaner moves along the guardrail under its own power. Since the guardrail cleaner according to this invention does not have to be equipped with special means for supporting it on the guardrail, it is structurally simple.

Moreover, no water, compressed air or the like is required for the cleaning since the wire buffing wheel is configured to clean the guardrail by buffing its entire wavy surface at one time. Therefore, as no replenishment is required, the cleaning operation is highly efficient. The dried mud and dust thrown off by the wire buffing wheel is collected in the dirt catcher and does not foul the road surface. When the guardrail cleaner is equipped with the paint spraying nozzles, it can easily and simultaneously clean and paint long guardrail sections.

The above and other objects and features of the present invention will become apparent from the following description made with reference to the drawings.

DESCRIPTION OF THE PREFERRED EMBODIMENTS

Figure 1:
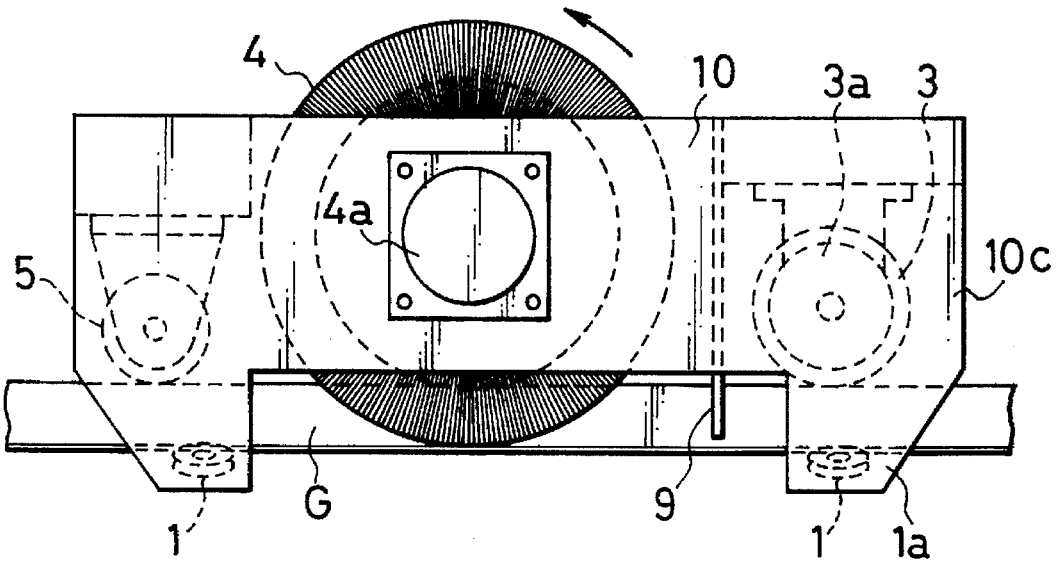
FIG. 1 is a plan view showing a guardrail cleaner that is an embodiment of the invention.
Figure 2:
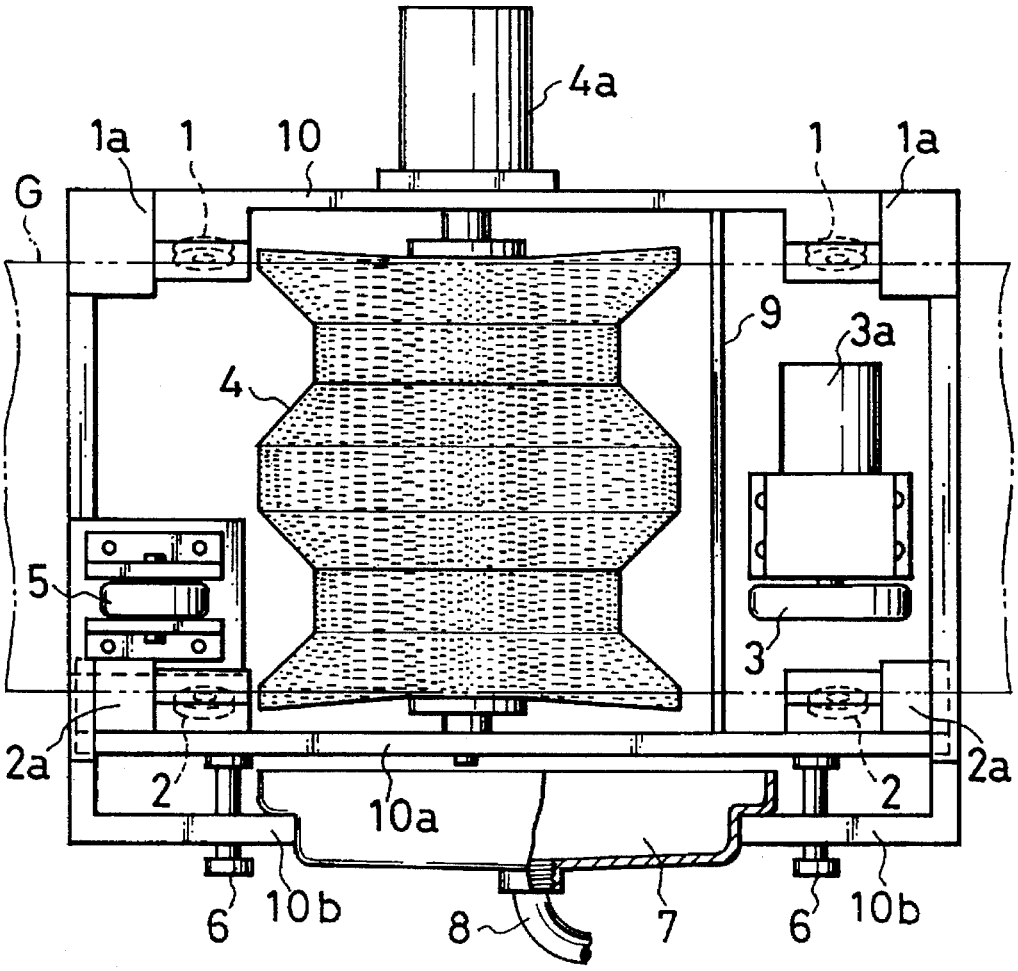
FIG. 2 is a front view of the guardrail cleaner of FIG. 1.
Figure 3:
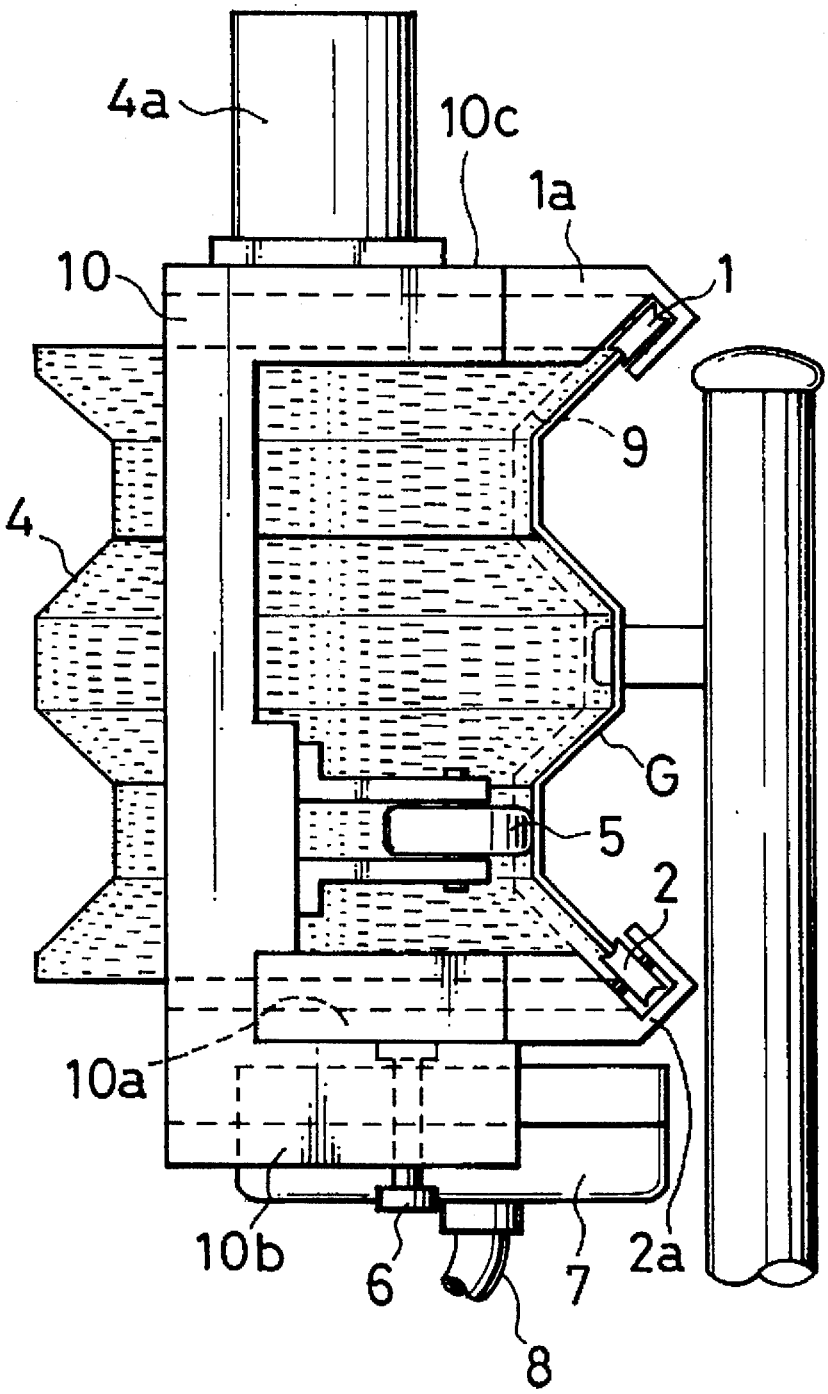
FIG. 3 is a side view of the guardrail cleaner of FIG. 1.

FIGS. 1, 2 and 3 show a guardrail cleaner that is an embodiment of the invention. The guardrail cleaner has a frame 10, and two upper V-groove rollers 1 for mating with the upper edge of a guardrail G are fixed to opposite ends of the top of the frame 10 by support arms 1*a*. A pair of lower rollers 2 for preventing separation of the frame from the guardrail G by engagement with the rear side of the guardrail are fixed to opposite ends of the bottom of the frame 10 by support arms 2*a*. The length of the support arms 2*a* can be adjusted for regulating the point of contact with the guardrail.

A drive wheel 3 for moving the guardrail cleaner along the guardrail by traction on the guardrail surface is provided near one end of the frame 10 and a motor-with-speed-reducer 3*a* is connected with the drive wheel 3 for rotating it. An auxiliary wheel 5 is provided at the other end of the frame 10 but can be omitted in cases where it is found unnecessary for stable travel of the cleaner along the guardrail.

A wire buffing wheel 4, the primary cleaning means, is rotatably supported at the middle of the frame 10. The shaft of the wire buffing wheel 4 extends through an upper frame member 10*c* of the frame 10 and connects with a motor 4*a* mounted on the upper frame member 10*c*. The motor 4*a* rotates the buffing wheel 4 at a prescribed speed. In the illustrated embodiment, the wire buffing wheel 4 is constituted of lower, middle and upper sections fastened integrally at the time they are fitted on the shaft. This configuration makes it possible to replace only the most heavily worn section when necessary and also enables the positioning of the sections to be changed according to the shape of the guardrail. It is not necessary for wire tips to be present over the entire periphery of the wire buffing wheel 4. Specifically, the wire buffing wheel 4 can instead be configured of vertically long brushes mounted back to back to extend radially.

In this embodiment, the lower frame member 10*a* of the frame 10, which substantially supports the wire buffing wheel 4, is fastened to the frame 10 to be vertically movable. Specifically, the opposite ends of the lower frame member 10*a* are fit in grooves formed in the frame 10 and the bottom surface of the lower frame member 10*a* is supported on left and right adjustment screws 6 engaged with threaded holes in shelves 10*b* extending inward from the opposite side frame members of the frame 10. When the lower frame member 10*a* is to be lowered from the position shown in FIG. 2, a dirt catcher 7 (explained below) is temporarily removed to facilitate turning of the adjustment screws 6. This configuration makes it easy to load and unload the wire buffing wheel 4.

The dirt catcher 7 is supported under the wire buffing wheel 4 by the opposite shelves 10*b* and opens toward the wire buffing wheel 4. It has a suction pipe 8 connected with a dirt collector (not shown).

When the guardrail cleaner of the foregoing structure is to be used to clean a guardrail, a wire buffing wheel 4 of a shape matched to the contour of the guardrail to be cleaned is first loaded in the frame 10. The upper V-groove rollers 1 are then mated with the upper edge of the guardrail G so that the weight of the cleaner is borne by the guardrail G. The length of the support arms 2*a* is adjusted to mate the lower rollers 2 with the lower edge of the guardrail and bring the wire buffing wheel 4 into contact with the surface of the guardrail G. The lower rollers 2 are for preventing the lower part of the frame 10 from separating from the guardrail. A single lower roller suffices insofar as it can provide this function.

As explained earlier, the cleaner is mounted on the guardrail G by clamping the guardrail G between the upper rollers 1 and the lower rollers 2, whereafter the motors 3*a* and 4*a* are operated. As a result, the cleaner advances along the guardrail G with the rotating drive wheel 3 pressed against the surface of the guardrail. The magnitude of the force pressing the drive wheel 3 onto the guardrail at this time is determined by the angular moment of the cleaner under its own weight and the force of the lower rollers 2 on the rear surface of the guardrail at its lower edge.

The wire buffing wheel 4 is rotated by the motor 4*a* to buff dust and dried mud off the guardrail surface. The dust and dried mud thrown off by the wire buffing wheel 4 strikes a dirt drop plate 9 provided near the wire buffing wheel 4, falls into the dirt catcher 7 and is sucked into the suction pipe 8 and collected in the dirt collector (not shown). A generator for supplying the dirt collector and the motors with electric power is carried on a separate vehicle.

Figure 4:
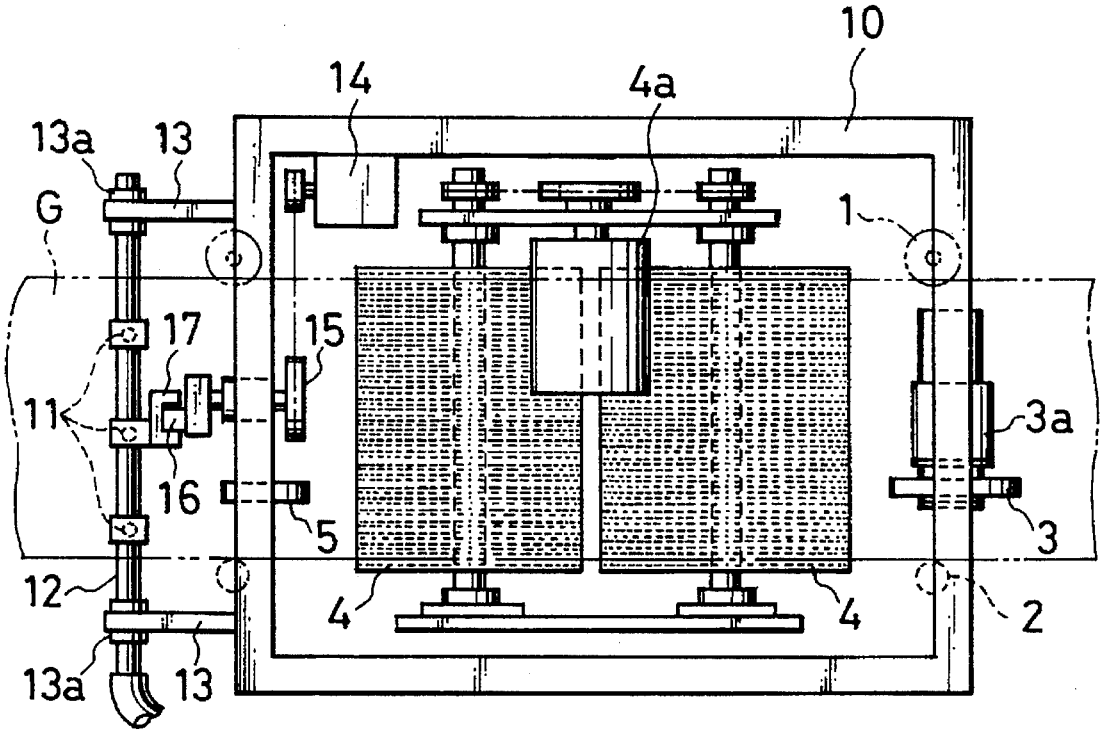
FIG. 4 is a front view of a guardrail cleaner that is another embodiment of the invention.
Figure 5:
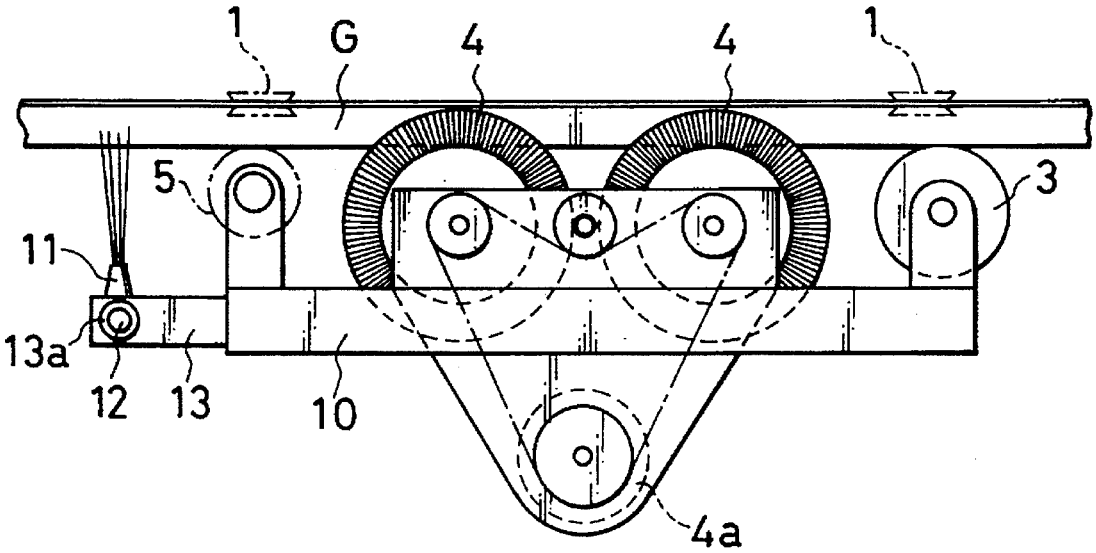
FIG. 5 is a plan view of the guardrail cleaner of FIG. 4.
Figure 6:
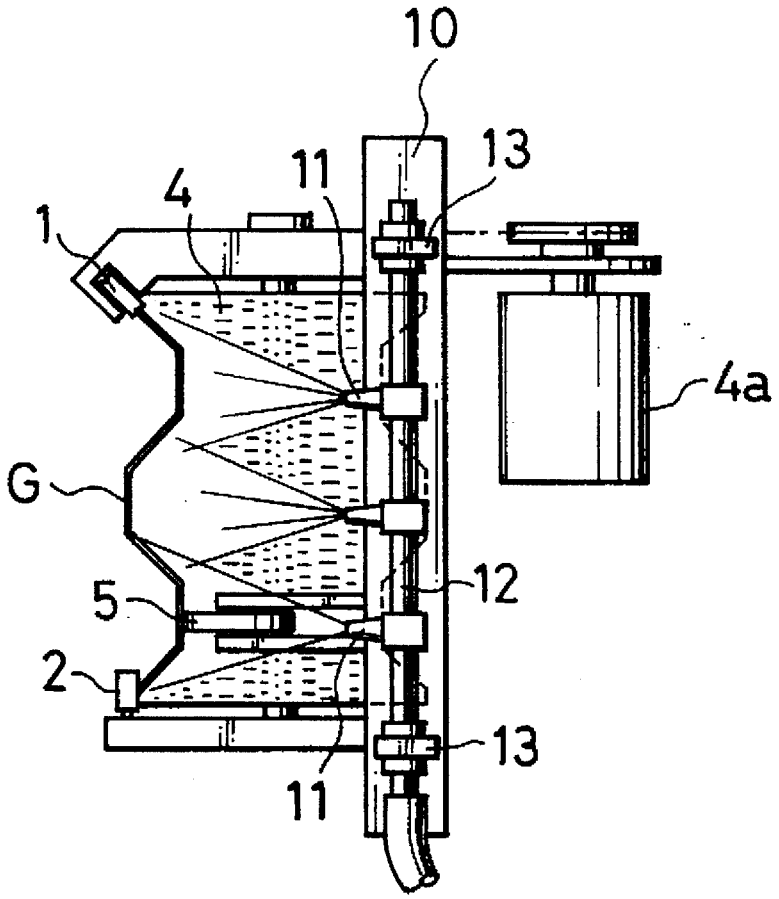
FIG. 6 is a side view of the guardrail cleaner of FIG. 4.

FIGS. 4, 5 and 6 show a guardrail cleaner that is another embodiment of the invention. This embodiment differs from that of FIGS. 1, 2 and 3 in that two wire buffing wheels 4 are provided in tandem and that the tail end of the frame 10 is installed with a paint feed pipe 12 fitted with multiple paint spraying nozzles 11 arrayed vertically.

As shown in FIG. 5, the two wire buffing wheels 4 are driven in the same direction at the same speed by the motor 4*a*. With this embodiment of the cleaner, the surface of the guardrail is buffed by the buffing wheels to remove dust and dried mud twice in succession and the cleaned surface is then painted with paint sprayed from the paint spraying nozzles 11.

The paint feed pipe 12 supporting the paint spraying nozzles 11 is supported to be slidable up and down by bearings 13*a* of upper and lower support arms 13 projecting from the tail end of the frame 10. A horizontal cam 17 is fixed to the paint feed pipe 12 and a mechanism for converting the rotating motion of a pulley 15 driven through a V-belt by a motor 14 (FIG. 4) into vertical reciprocating motion (which in this embodiment comprises a pin 16 which rotates eccentrically relative to the pulley 15 and the horizontal cam 17) repeatedly reciprocates the paint feed pipe 12 vertically. Since the paint spraying nozzles 11 therefore advance along the guardrail while being reciprocated vertically, the surface of the guardrail can be uniformly painted.

The guardrail cleaner according to this invention thus enables the work of guardrail cleaning conventionally conducted by workers to be conducted by machine with a quantum increase in efficiency.

Owing to the adoption of one or more wire buffing wheels as the cleaning means, dust and dried mud adhering to guardrails can be removed without using water or compressed air. In addition, the dirt thrown off by the buffer wheel is collected and prevented from being scattered about. The invention can therefore be expected to have a very great effect when applied to the huge amount of guardrail cleaning and painting work required.

Obviously, numerous modifications and variations of the present invention are possible in light of the above teachings. It is therefore to be understood that within the scope of the appended claims, the invention may be practiced otherwise than as specifically described herein.

What is claimed is:

1. A guardrail cleaner comprising a frame equipped with multiple upper rollers for mating with an upper edge of a guardrail and at least one lower roller for contacting a rear surface of the guardrail at its lower edge, a drive wheel mounted on the frame for moving the cleaner along the guardrail by traction on a surface thereof, rotating means mounted on the frame for rotating the drive wheel, at least one wire buffing wheel rotatably supported between upper and lower bearings for cleaning the guardrail surface by buffing, and means for rotating the wire buffing wheel.

2. A guardrail cleaner according to claim 1, further comprising a dirt catcher mounted on the frame for collecting dust and dried mud thrown off from the guardrail surface by the buffing wheel.

3. A guardrail cleaner according to claim 1, further comprising multiple paint spraying nozzles provided at a rearward end of the frame.

* * * * *